United States Patent [19]

Shepherd

[11] Patent Number: 4,501,708

[45] Date of Patent: Feb. 26, 1985

[54] REPAIR PAD AND NOZZLE FOR COOLING TOWER

[76] Inventor: Charles E. Shepherd, 4202 Markham, Houston, Tex. 77027

[21] Appl. No.: 404,696

[22] Filed: Aug. 3, 1982

[51] Int. Cl.[3] ..... B01F 3/04

[52] U.S. Cl. ..... 261/111; 239/500; 239/504; 239/600; 261/DIG. 11; 277/11; 277/178

[58] Field of Search ..... 261/111, DIG. 11; 239/396, 500, 504, 550, 553.3, 600; 277/11, 178, 212 F

[56] References Cited

U.S. PATENT DOCUMENTS

| | | | |
|---|---|---|---|
| 3,061,204 | 10/1962 | MacInnes et al. | 239/500 |
| 3,351,328 | 11/1967 | Vetterli | 261/DIG. 11 |
| 3,617,036 | 11/1971 | Brown | 261/111 |
| 3,899,553 | 8/1975 | Furlong et al. | 261/DIG. 11 |
| 3,977,431 | 8/1976 | Ovard et al. | 261/DIG. 11 |
| 3,995,332 | 12/1976 | Forchini et al. | 261/DIG. 11 |
| 4,055,205 | 10/1977 | Withoff et al. | 277/212 F X |
| 4,055,305 | 10/1977 | Schwinn | 261/111 X |
| 4,099,675 | 7/1978 | Wohler et al. | 261/111 X |
| 4,320,072 | 3/1982 | Arndt | 261/DIG. 11 |
| 4,350,302 | 9/1982 | Gruber et al. | 239/500 |

FOREIGN PATENT DOCUMENTS

| | | | |
|---|---|---|---|
| 423094 | 4/1911 | France | 261/DIG. 11 |
| 667393 | 2/1952 | United Kingdom | 277/178 |

*Primary Examiner*—Richard L. Chiesa

*Attorney, Agent, or Firm*—Schwartz, Jeffery, Schwaab, Mack, Blumenthal & Koch

[57] ABSTRACT

The repair pad comprises a generally flat flange having a central opening for receiving a spray nozzle and a generally cylindrical mounting element which is attached to the flange of the central opening and depends from the central opening for attachment to the body of the spray nozzle. The pad is used with a spray nozzle having a generally cylindrical body which is received in the cylindrical mounting element, a mounting flange connected to one end of the body and disposed in contact with the flat flange, and a dispersion plate connected to the opposite end of the cylindrical body for dispersing liquid contacting the dispersion plate.

6 Claims, 5 Drawing Figures

REPAIR PAD AND NOZZLE FOR COOLING TOWER

BACKGROUND OF THE INVENTION

1. Field of the Invention

This invention relates to liquid spray devices for use in a gas and liquid contact apparatus, and especially to such devices which are adapted for use in water cooling towers wherein water is distributed over the top of fill elements to be cooled by a cross- or countercurrent flow of gas, such as air.

2. Discussion of Related Art

In a gas and liquid contact apparatus, such as a cooling tower used for reducing the temperature of cooling water from processing plants, for example, fill elements are disposed within a housing in which there is developed a crosscurrent or countercurrent flow of air. The water to be cooled is sprayed onto the fill elements from above. In order to provide maximum contact time between the water and air and thus maximum efficiency and cooling effect, it is essential that the water be dispersed evenly over the fill elements and flow smoothly down the fill elements.

Many nozzle constructions have been suggested for distributing water evenly over fill elements. One example of a highly effective construction is shown in U.S. patent application Ser. No. 262,990, filed May 12, 1981, now U.S. Pat. No. 4,390,478, of which is incorporated herein by reference. As clearly shown in this application, the spray assemblies are mounted in a pan disposed over the fill elements. A conventional mounting construction comprises a hole formed in the pan in which the spray assemblies are mounted. However, with time, these holes become wallowed out allowing water to be cooled to flow past the spray assemblies thereby decreasing the cooling effect of the assemblies. Eventually, the opening becomes so large that the spray assemblies are lifted out of the holes leaving the holes open whereby the water to be cooled flows directly through the open holes thus even further reducing the cooling effect of the system.

In the past, repairs have been made by installing oversized nozzles in the wallowed out holes. However, such repairs are difficult since the holes must be reamed to oversized dimensions to accommodate the larger nozzles.

Accordingly, a need has arisen for a device which enables spray nozzles to be repaired and replaced in cooling towers without requiring an undue amount of effort.

SUMMARY OF THE INVENTION

One object of the present invention is to provide a repair pad for use with cooling tower spray nozzles which pad can be used to mount a spray nozzle in an orifice hole which has become enlarged due to age and corrosive water action.

Another object of the present invention is to provide a pad for use with spray nozzles which pad can be formed as a unitary construction in a single injection molding process.

A further object of the present invention is to provide a repair pad for spray nozzles which pad can also be used as a shimming pad to allow smaller nozzles to fit snugly in larger orifice holes.

Another object of the present invention is to provide a repair pad which is formed integrally with a spray nozzle wherein the combination pad and spray nozzle comprise a unitary construction capable of being formed in a single injection molding process.

A still further object of the present invention is to provide a combined repair pad and spray nozzle in which the nozzle is adapted to accept a filter screen.

In accordance with the above and other objects, the repair pad of the present invention comprises a generally flat flange having a central opening for receiving a spray nozzle, and a generally cylindrical mounting element attached to the flange at the central opening. The mounting element depends from the center opening and is adapted for attachment to a body of the spray nozzle. The repair pad also includes a plurality of mounting holes formed at an outer edge of the flange to accept brads or other attaching devices.

In accordance with other objects, the pad is used in combination with a specific spray nozzle having a generally cylindrical body received in the cylindrical mounting element and a mounting flange connected to one end of the body, which mounting flange is disposed in contact with the generally flat flange of the repair pad. Dispersion means are connected to the opposite end of the cylindrical body for dispersing liquid contacting the dispersion means.

In accordance with still further objects, the spray nozzle and flat flange are formed as a unitary construction in which the flat flange extends radially outward from the nozzle mounting flange.

DESCRIPTION OF THE PREFERRED EMBODIMENT

Figure 1:
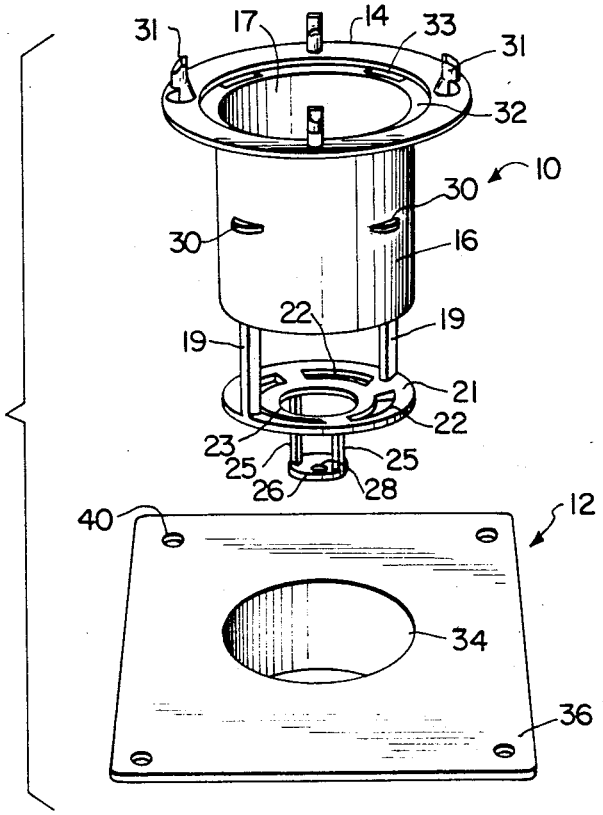
FIG. 1 shows an exploded view of a nozzle body and repair pad of the present invention.
Figure 2:
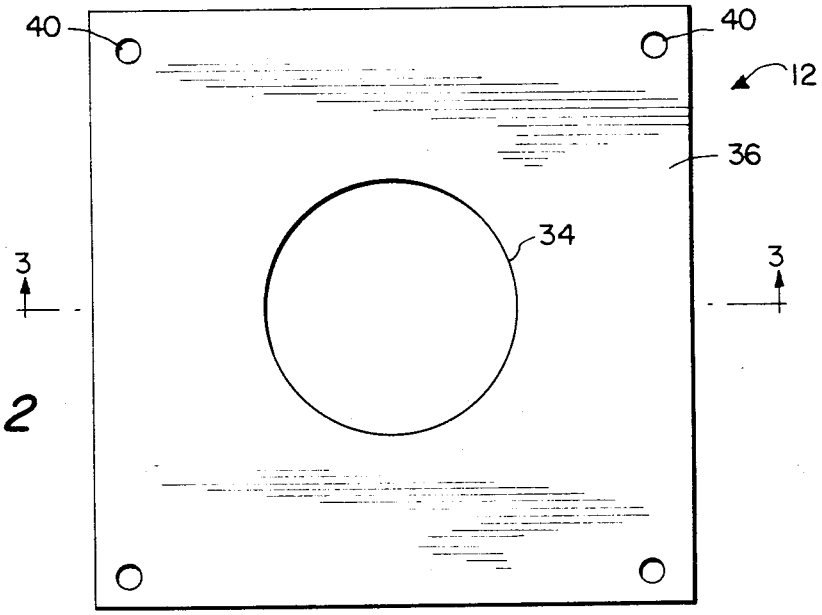
FIG. 2 shows a top plan view of the repair pad of FIG. 1.
Figure 3:
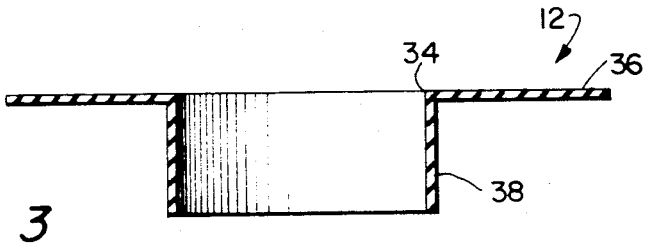
FIG. 3 shows an elevational sectional view of the flange of FIG. 2 taken through section line 3—3.
Figure 4:
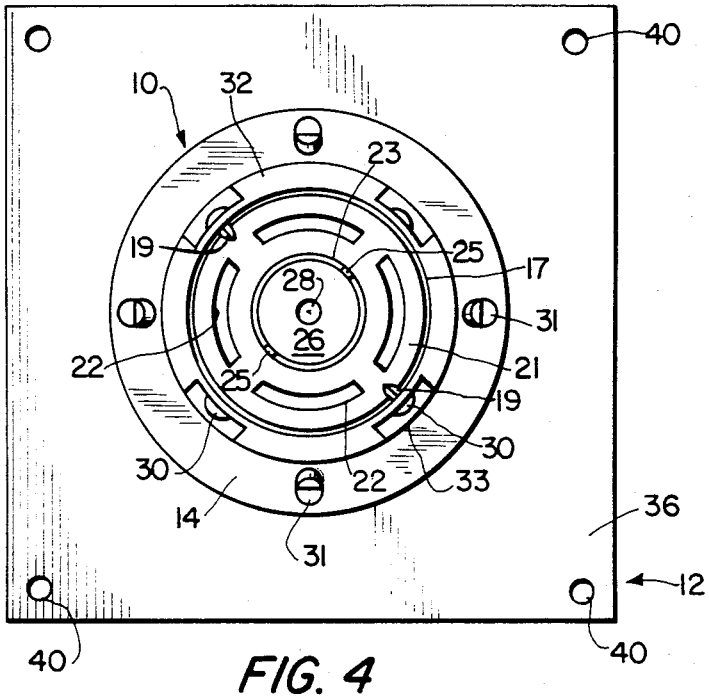
FIG. 4 is a top plan view of the repair pad mounted on a nozzle body.

FIGS. 1–4 show a nozzle 10 which can be used with repair pad 12 of the present invention. Nozzle 10 includes a mounting flange 14 which is generally ring shaped and mounted to a nozzle body 16. Nozzle body 16 is cylindrical in shape and includes a cylindrical body opening 17 through which water to be cooled passes. Two downward projections 19 are attached to the inside of body 16 and, at their lower extremities, mount dispersion plate 21. Dispersion plate 21 is shaped as an inverted hollow frustum and contains several slots 22 and a central opening 23. Slots 22 extend circumferentially of the body 21 between the outer edge of that body and opening 23. Two additional vertical supports 25 are mounted to the lower surface of body 21 and extend downwardly to mount a secondary dispersion plate 26. Dispersion plate 26 is also shaped as an inverted frustum hollow and contains a central opening 28. The outer diameter of dispersion plate 21 is approximately equal to the inner diameter of body 17, and the outer diameter of dispersion plate 26 is approximately equal to the diameter of opening 23.

In operation, water to be cooled flows through body opening 17 of the nozzle and impinges upon plate 21.

Plate 21 causes the water to spray outwardly and also allows water to fall through slots 22. Also, water falls through opening 23 and impinges upon plate 26. This water is sprayed outwardly by plate 26 and some of the water falls through opening 28. The resultant spray pattern extends over a relatively wide area compared to the size of nozzle 10, and, due to dispersion plates 21 and 26, is evenly distributed over this area.

In order to hold the spray nozzle in an opening formed for it, lateral projections 30 are included and are spaced from mounting flange 14 by a distance equal to the thickness of the plate on which the spray nozzle 10 is to be mounted. Additional features of the spray nozzle include hooks 31 mounted on mounting flange 14 for connection to a screen which is designed to fit over the top of the nozzle to filter out debris and the like. Such a screen is disclosed in aforementioned U.S. patent application Ser. No. 262,990, now U.S. Pat. No. 4,390,478. Additional holes 33 are shown. These holes are included for the purpose of enabling projections 30 to be formed in an injection molding operation.

Nozzle 10 is disclosed for purposes of showing an exemplary embodiment which can be used with repair pad 10. However, other nozzle designs may work as well. For example, the nozzle shown in aforementioned U.S. patent application Ser. No. 262,990 can also be used with pad 12.

Pad 12 is shown in FIGS. 1–4 and includes a generally flat flange 36 with a central opening 34. A cylindrical skirt 38 is attached to flange 36 around the periphery of opening 34 and extends downwardly. Holes 40 are formed at the outer periphery of flange 36 for accepting brads, screws or other attachment devices for attaching pad 12 to a pan which receives spray nozzles. Cylindrical skirt 38 has an inner diameter which is equal to the outer diameter of body 16. Accordingly, there is a snug fit when the pad 12 is mounted on nozzle 10. The axial dimension of skirt 38 is approximately equal to the depth of a pan on which nozzle 10 is mounted. Accordingly, projections 30 project from the bottom of skirt 38 and assist in holding nozzle 10 in pad 12 when the nozzle and pad are connected.

Both the nozzle and pad should be made out of a synthetic resin material such as polyethylene, polypropylene, or PVC, for best results. However, any moldable material or formed sheet metal could be used.

Flange 36 is preferably four inches by four inches and the diameter of hole 34 is approximately $1\frac{5}{8}$ inches. The axial dimension of skirt 38 is approximately $\frac{3}{4}$ of an inch. These dimensions, of course, would vary with the application in which the pad is to be used. However, the dimensions as given can be used in a large number of existing cooling tower applications. It should also be noted that, while flange 36 is shown as being square in design, other configurations can also be used. The square design is shown in the present exemplary embodiment as being the most efficient design for producing the flange.

In use, repair pad 12 can be mounted to nozzle 10 and the combined structure mounted to a wallowed out hole in a cooling tower water distribution pan. Flange 36 will cover the hole adequately and brads or screws can be used to secure the combined structure to the pan. Additionally, since there will normally be water pressure on top of flange 36 and no water pressure below, this water pressure will assist in holding flange 36 in place.

Pad 12 is also useful in simply adapting nozzle 10 for use in cooling tower pans having original oversized orifice holes. Clearly, pad 12 can be mounted to nozzle 10 prior to fitting the nozzle into the orifice holes of the water distribution pan. The dimensions of skirt 36 would be made to provide a snug fit within an orifice hole.

Figure 5:
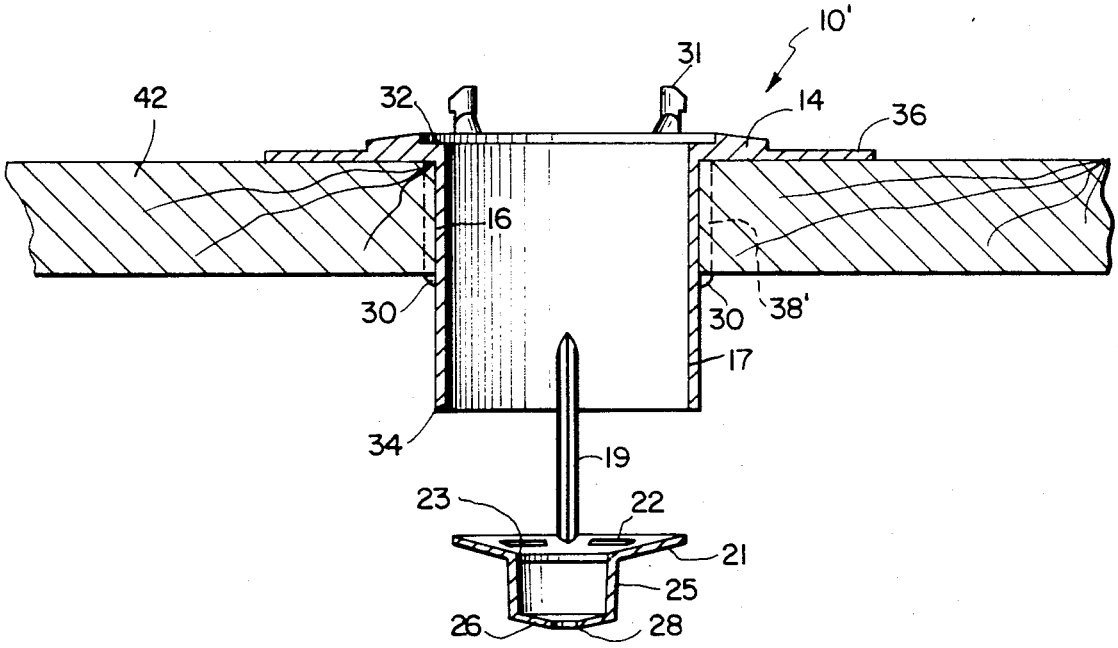
FIG. 5 is an elevational sectional view of a second embodiment of the present invention.

FIG. 5 shows a nozzle 10' which combines the features of nozzle 10 and repair pad 12. In nozzle 10', square flange 36 is formed integrally with mounting flange 14. By so forming the nozzle and flange as a unitary structure, nozzle 10' can be used in cooling tower repair applications. Also, if nozzle 10' is used in the initial nozzle installation, the likelihood of erosion of the pan 42 in which the nozzle is mounted, is reduced.

Also, if necessary, body 16 of nozzle 10' can be enlarged as shown in phantom at 38' to adapt the nozzle to fit to larger size openings. Enlarged portion 38' corresponds to skirt 38 of pad 12.

The foregoing description is presented for purposes of description and is not considered to be limitative of the present invention. Clearly, numerous additions, modifications and other changes can be made to the invention without departing from the scope thereof, as set forth in the appended claims.

What is claimed is:

1. In combination, a repair pad for use with a cooling tower spray nozzle, comprising: a generally flat flange having a central opening for receiving said spray nozzle; a generally cylindrical mounting element attached to said flange at said central opening and depending from said central opening for attachment to a body of said spray nozzle; and a spray nozzle having a generally cylindrical body received in said cylindrical mounting element, a mounting flange connected to one end of said body and disposed in contact with an upper surface of said flat flange, dispersion means connected to the opposite end of said cylindrical body for dispersing liquid contacting said dispersion means, and means for holding said spray nozzle in said generally cylindrical mounting element, said holding means comprising a plurality of circumferentially spaced radially outwardly projecting elements mounted to said generally cylindrical body at a position where said projecting elements engage a lower surface of said generally cylindrical mounting element.

2. The repair pad as set forth in claim 1, wherein said pad further includes a plurality of mounting holes formed at an outer edge of said flange.

3. The repair pad as set forth in claim 1 or 2, wherein said flange is generally rectangular in shape.

4. The combination as set forth in claim 1, wherein said dispersion means comprises a frustum shaped body, and means for connecting said frustum shaped body in spaced relation below said opposite end of said cylindrical body.

5. The combination as set forth in claim 4, wherein said frustum shaped body includes a central opening, an outer edge, and a plurality of circumferentially oriented slots disposed between said central opening and said outer edge.

6. The combination as set forth in claim 5, wherein said dispersion means includes a second frustum shaped body, and means for connecting said second frustum shaped body in spaced relation below said first mentioned frustum shaped body.

* * * * *